US010721566B2

(12) United States Patent
Tjepkema et al.

(10) Patent No.: US 10,721,566 B2
(45) Date of Patent: Jul. 21, 2020

(54) RECEIVER ASSEMBLY COMPRISING AN ARMATURE AND A DIAPHRAGM

(71) Applicant: Sonion Nederland B.V., Hoofddorp (NL)

(72) Inventors: Mattijs Tjepkema, Hoofddorp (NL); Jan Hijman, Hoofddorp (NL); Gerardus Johannes Franciscus Theodorus van der Beek, Hoofddorp (NL); Camiel Eugène Groffen, Hoofddorp (NL); Tomasz Kaszuba, Hoofddorp (NL); Krzysztof Bialy, Hoofddorp (NL); Grzegorz Kurpiel, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 139 days.

(21) Appl. No.: 15/989,302

(22) Filed: May 25, 2018

(65) Prior Publication Data

US 2018/0367916 A1 Dec. 20, 2018

(30) Foreign Application Priority Data

May 26, 2017 (EP) ..... 17173092

(51) Int. Cl.
*H04R 9/00* (2006.01)
*H04R 9/02* (2006.01)
(Continued)

(52) U.S. Cl.
CPC ..... *H04R 9/027* (2013.01); *H04R 3/002* (2013.01); *H04R 3/007* (2013.01); *H04R 7/16* (2013.01);
(Continued)

(58) Field of Classification Search
CPC ..... H04R 11/02
See application file for complete search history.

(56) References Cited

U.S. PATENT DOCUMENTS 3,617,653 A * 11/1971 Tibbetts ..... H04R 11/02 310/36
4,272,654 A * 6/1981 Carlson ..... H04R 11/00 29/594
(Continued)

FOREIGN PATENT DOCUMENTS

GB 2 336 065 10/1999
KR 2009-0059341 A 6/2009
WO WO 2007/140403 A2 12/2007

OTHER PUBLICATIONS

Extended European Search Report in European Patent Application No. 17173092.2, dated Dec. 6, 2017 (3 pages).
(Continued)

*Primary Examiner* — Matthew A Eason
(74) *Attorney, Agent, or Firm* — Nixon Peabody LLP

(57) ABSTRACT

The present invention provides a receiver assembly. The receiver assembly comprises a receiver housing comprising a first housing part and a second housing part. The receiver housing defines an inner space, and the first housing part and the second housing part are movable relative to each other to define an open configuration and a closed configuration. The receiver assembly further comprises an armature extending in a first direction in the inner space, and a diaphragm operationally attached to the armature via a drive pin extending in a second direction, where the first and second directions are different. The drive pin and the armature are formed in one part. A circumferential edge part of the diaphragm is arranged in a joint between the first housing part and the second housing part in the closed configuration.

16 Claims, 10 Drawing Sheets

(51) Int. Cl.

| | |
|---|---|
| ***H04R 11/02*** | (2006.01) |
| ***H04R 25/00*** | (2006.01) |
| ***H04R 3/00*** | (2006.01) |
| ***H04R 7/16*** | (2006.01) |
| ***H04R 31/00*** | (2006.01) |

(52) U.S. Cl.
CPC ..... *H04R 11/02* (2013.01); *H04R 25/60* (2013.01); *H04R 31/003* (2013.01)

(56) References Cited

U.S. PATENT DOCUMENTS

| | | | | |
|---|---|---|---|---|
| 6,788,796 | B1 | 9/2004 | Miles | |
| 6,831,577 | B1 | 12/2004 | Furst | |
| 6,853,290 | B2 | 2/2005 | Jorgensen | |
| 6,859,542 | B2 | 2/2005 | Johannsen | |
| 6,888,408 | B2 | 5/2005 | Furst | |
| 6,914,992 | B1 | 7/2005 | van Halteren | |
| 6,919,519 | B2 | 7/2005 | Ravnkilde | |
| 6,930,259 | B1 | 8/2005 | Jorgensen | |
| 6,943,308 | B2 | 9/2005 | Ravnkilde | |
| 6,974,921 | B2 | 12/2005 | Jorgensen | |
| 7,008,271 | B2 | 3/2006 | Jorgensen | |
| 7,012,200 | B2 | 3/2006 | Moller | |
| 7,062,058 | B2 | 6/2006 | Steeman | |
| 7,062,063 | B2 | 6/2006 | Hansen | |
| 7,072,482 | B2 | 7/2006 | Van Doorn | |
| 7,088,839 | B2 | 8/2006 | Geschiere | |
| 7,110,560 | B2 | 9/2006 | Stenberg | |
| 7,136,496 | B2 | 11/2006 | van Halteren | |
| 7,142,682 | B2 | 11/2006 | Mullenborn | |
| 7,181,035 | B2 | 2/2007 | van Halteren | |
| 7,190,803 | B2 * | 3/2007 | van Halteren | H04R 11/02 381/398 |
| 7,206,428 | B2 | 4/2007 | Geschiere | |
| 7,221,767 | B2 | 5/2007 | Mullenborn | |
| 7,221,769 | B1 | 5/2007 | Jorgensen | |
| 7,227,968 | B2 | 6/2007 | van Halteren | |
| 7,239,714 | B2 | 7/2007 | de Blok | |
| 7,245,734 | B2 | 7/2007 | Niederdraenk | |
| 7,254,248 | B2 | 8/2007 | Johannsen | |
| 7,286,680 | B2 | 10/2007 | Steeman | |
| 7,292,700 | B1 | 11/2007 | Engbert | |
| 7,292,876 | B2 | 11/2007 | Bosh | |
| 7,336,794 | B2 | 2/2008 | Furst | |
| 7,376,240 | B2 | 5/2008 | Hansen | |
| 7,403,630 | B2 | 7/2008 | Jorgensen | |
| 7,415,121 | B2 | 8/2008 | Mögelin | |
| 7,425,196 | B2 | 9/2008 | Jorgensen | |
| 7,443,997 | B2 * | 10/2008 | Miller | H04R 11/02 381/322 |
| 7,460,681 | B2 | 12/2008 | Geschiere | |
| 7,466,835 | B2 | 12/2008 | Stenberg | |
| 7,492,919 | B2 | 2/2009 | Engbert | |
| 7,548,626 | B2 | 6/2009 | Stenberg | |
| 7,657,048 | B2 | 2/2010 | van Halteren | |
| 7,684,575 | B2 | 3/2010 | van Halteren | |
| 7,706,561 | B2 | 4/2010 | Wilmink | |
| 7,715,583 | B2 | 5/2010 | Van Halteren | |
| 7,728,237 | B2 | 6/2010 | Pedersen | |
| 7,809,151 | B2 | 10/2010 | Van Halteren | |
| 7,822,218 | B2 | 10/2010 | Van Halteren | |
| 7,899,203 | B2 | 3/2011 | Van Halteren | |
| 7,912,240 | B2 | 3/2011 | Madaffari | |
| 7,946,890 | B1 | 5/2011 | Bondo | |
| 7,953,241 | B2 | 5/2011 | Jorgensen | |
| 7,961,899 | B2 | 6/2011 | Van Halteren | |
| 7,970,161 | B2 | 6/2011 | van Halteren | |
| 8,098,854 | B2 | 1/2012 | van Halteren | |
| 8,101,876 | B2 | 1/2012 | Andreasen | |
| 8,103,039 | B2 | 1/2012 | van Halteren | |
| 8,135,163 | B2 * | 3/2012 | Blanchard | H04R 3/14 381/349 |
| 8,160,290 | B2 | 4/2012 | Jorgensen | |
| 8,170,249 | B2 | 5/2012 | Halteren | |
| 8,189,804 | B2 | 5/2012 | Hruza | |
| 8,189,820 | B2 | 5/2012 | Wang | |
| 8,223,996 | B2 | 7/2012 | Beekman | |
| 8,233,652 | B2 | 7/2012 | Jorgensen | |
| 8,259,963 | B2 | 9/2012 | Stenberg | |
| 8,259,976 | B2 | 9/2012 | van Halteren | |
| 8,259,977 | B2 | 9/2012 | Jorgensen | |
| 8,280,082 | B2 | 10/2012 | van Halteren | |
| 8,284,966 | B2 | 10/2012 | Wilk | |
| 8,313,336 | B2 | 11/2012 | Bondo | |
| 8,315,422 | B2 | 11/2012 | van Halteren | |
| 8,331,595 | B2 | 12/2012 | van Halteren | |
| 8,369,552 | B2 | 2/2013 | Engbert | |
| 8,379,899 | B2 | 2/2013 | van Halteren | |
| 8,509,468 | B2 | 8/2013 | van Halteren | |
| 8,526,651 | B2 | 9/2013 | Lafort | |
| 8,526,652 | B2 | 9/2013 | Ambrose | |
| 8,712,084 | B2 * | 4/2014 | Mocking | H04R 11/02 381/182 |
| 2004/0151340 | A1 * | 8/2004 | Miller | H04R 11/02 381/417 |
| 2007/0058833 | A1 * | 3/2007 | Van Halteren | H04R 11/02 381/415 |
| 2011/0182453 | A1 | 7/2011 | van Hal | |
| 2011/0189880 | A1 | 8/2011 | Bondo | |
| 2011/0299708 | A1 | 12/2011 | Bondo | |
| 2011/0299712 | A1 | 12/2011 | Bondo | |
| 2011/0311069 | A1 | 12/2011 | Ambrose | |
| 2012/0014548 | A1 | 1/2012 | van Halteren | |
| 2012/0027245 | A1 | 2/2012 | van Halteren | |
| 2012/0140966 | A1 | 6/2012 | Mocking | |
| 2012/0155683 | A1 | 6/2012 | van Halteren | |
| 2012/0155694 | A1 | 6/2012 | Reeuwijk | |
| 2012/0255805 | A1 | 10/2012 | van Halteren | |
| 2013/0028451 | A1 | 1/2013 | de Roo | |
| 2013/0136284 | A1 | 5/2013 | van Hal | |
| 2013/0142370 | A1 | 6/2013 | Engbert | |
| 2013/0163799 | A1 | 6/2013 | Van Halteren | |
| 2013/0195295 | A1 | 8/2013 | van Halteren | |
| 2015/0010199 | A1 * | 1/2015 | Kim | H04R 11/02 381/417 |
| 2015/0207392 | A1 * | 7/2015 | Iwakura | H02K 33/00 310/25 |
| 2015/0256935 | A1 | 9/2015 | Lucas | |
| 2015/0289060 | A1 * | 10/2015 | Bolsman | H04R 11/02 381/417 |
| 2016/0183004 | A1 * | 6/2016 | Jiles | H04R 11/02 381/418 |
| 2018/0343515 | A1 * | 11/2018 | Hijman | H04R 1/025 |

OTHER PUBLICATIONS

Extended European Search Report in European Patent Application No. 18174233.9, dated Oct. 4, 2018 (3 pages).

* cited by examiner

RECEIVER ASSEMBLY COMPRISING AN ARMATURE AND A DIAPHRAGM

FIELD OF THE INVENTION

The present invention relates to receiver assembly comprising an armature and a diaphragm operationally attached to the armature via a drive pin. The invention further relates to a method of assembling a receiver assembly.

BACKGROUND OF THE INVENTION

Traditionally, assembling of receiver assemblies require multiple step including positioning of the drive pin relative to the armature and the diaphragm. This can deform the armature and/or the drive pin. Furthermore, gluing of the drive pin to the armature requires a curing step. During this curing step the drive pin may move.

Additionally, attachment of the diaphragm requires a plurality of cams and/or recesses to keep is in place.

Thus, the assembling includes a series of process steps. Furthermore, assembling of receiver assemblies may result in a high reject rate, as the process steps including gluing, curing, and the like may be associated with a higher error rate due to the very small size of the different elements.

DESCRIPTION OF THE INVENTION

It is an object of embodiments of the invention to provide an improved an improved receiver assembly.

It is an object of further embodiments of the invention to provide an improved method of assembling a receiver assembly.

According to a first aspect, the invention provides a receiver assembly comprising:

- a receiver housing comprising a first housing part and a second housing part, the receiver housing defining an inner space, wherein the first housing part and the second housing part are movable relative to each other to define an open configuration and a closed configuration,
- an armature extending in a first direction in the inner space,
- a diaphragm operationally attached to the armature via a drive pin extending in a second direction, the first and second directions being different, wherein the drive pin and the armature are formed in one part, and wherein a circumferential edge part of the diaphragm is arranged in a joint between the first housing part and the second housing part in the closed configuration.

The receiver assembly may be adapted to form part of any personal audio device, such as a hearing aid, such as a Behind-the-Ear (BTE) device, an In the Ear (ITE) device, a Receiver in the Canal (RIC) device, or any other personal audio device, such as headphones, earphones, and other earpieces. In the context of the present invention, the term "hearing aid" shall be understood as a device which is adapted to amplify and modulate sound and to output this sound to a user, such as into the ear canal of a user.

It should further be understood, that the receiver assembly in one embodiment may be a balanced armature receiver, whereas the receiver assembly in other embodiments may also comprise other transducer technologies, such as moving coil, moving armature, magnetostatic, electrostatic, etc.

Thus, the receiver assembly may be adapted to receive an electrical signal and output a corresponding audio signal through a sound outlet.

The receiver assembly comprises a receiver housing comprising a first housing part and a second housing part. The first housing part and the second housing part are movable relative to each other to define an open configuration and a closed configuration. The receiver housing defines an inner space which in the closed configuration is a closed space.

In the context of the present invention, the term "closed space" should be understood as a space with limited communication to the outside. It should however be understood that there may be openings of different size, e.g. for wires, sound, venting, etc.

The first and second housing parts may be of the same size and shape. However, in one embodiment, the first housing part may form a container suitable for different elements of the receiver assembly, whereas the second housing part may form a lid configured to close the receiver housing and thereby form a closed space. It should be understood, that the first housing part may also form the lid, whereas the second housing part may also form the container.

The receiver assembly comprises an armature which extends in a first direction in the space. The armature may comprise at least one leg which extends in the first direction. In one embodiment, the armature is a U-shaped armature. In an alternative embodiment, the armature is an E-shaped armature. Armatures having another shape may however also be used.

The armature may be made from any type of suitable material being able to guide or carry a magnetic flux, such as mu-metal which is standardly composed of substantially 50% nickel and 50% iron (also called 50/50). Other variants, such as 80/20, may also be used. The armature may be electrically conducting or not.

The receiver assembly further comprises a diaphragm which is operationally attached to the armature, such that movement of the armature may be transferred to the diaphragm. It will be appreciated that movement of the diaphragm causes sound waves to be generated. The diaphragm is operationally attached to the armature via a drive pin.

The diaphragm may comprise a metal material such as steel, aluminium, nickel, or alternatively a plastic material, such as a polymer, or any other material. It should however be understood, that the diaphragm may comprise a plurality of materials. The diaphragm may divide the inner space of the receiver housing into two chambers, e.g. a front volume which is typically above the diaphragm and being connected to a sound output, and a back volume which is typically below the diaphragm and comprising the armature.

The diaphragm may comprise a movable part and may additionally comprise a static part. The static part may provide attachment of the diaphragm to the receiver housing. In one embodiment, the static part may at least party circumference the movable part of the diaphragm, thereby forming a frame part.

The receiver assembly may be located in an assembly housing which itself may form a soft shell or which may be located in a shell made of a soft material, such as silicone, to improve comfort of a user. To improve comfort further, an individual shell may be made for each user to fit the ear of the user. Other suitable materials for the assembly housing may be nylon, ABS (plastic), and metals, such as stainless steel, aluminium and titanium.

The drive pin and the armature are formed in one part; i.e. as an integral unit. In the context of the present invention, the term "formed in one part" should be understood as an element which is formed without a joint. Thus, the drive pin and the armature are not formed as two separate elements being subsequently assembled/joined.

Traditionally, assembling of receiver assemblies require multiple step including positioning of the drive pin relative to the armature and the diaphragm. This can deform the armature and/or the drive pin. Furthermore, gluing of the drive pin to the armature requires a curing step. During this curing step the drive pin may move.

By providing the drive pin and the armature as an integral units formed in one part, assembling of receiver assemblies may result in a lower reject rate, as some of the traditional process steps, such as gluing and curing may be omitted.

Furthermore, a separate drive pin which is joined with an armature is traditionally made from a sufficiently rigid material able to transfer mechanical energy from the armature to the diaphragm, such as steel, nickel, titanium, beryllium copper, and the like, e.g. by clamp fitting and subsequently sealing e.g. by use of an adhesive. By forming the drive pin and the armature as an integral unit in one part, this additional part and subsequently process steps can be omitted.

As the armature and the drive pin extend in two different directions, i.e. the armature in a first direction and the drive pin in a second direction, the process of manufacturing the integral unit may comprise a first step of manufacturing a substantially flat element, and a second step of shaping the element, so that the armature extends in a first direction and the drive pin extends in a second direction. The second step may be carried out by bending the integral unit whereby the armature extends in a first direction and the drive pin in a second direction, the second direction being transverse to the first direction. In one embodiment, the first and second directions may be substantially perpendicular to each other. However, the angle between the first direction and the second direction may be in the range of 60 to 120 degrees, such as in the range of 70 to 110 degrees, such as in the range of 80 to 100 degrees.

It should however be understood, that the manufacturing process may be carried out in a single process step as the integral unit may be moulded whereby the armature extends in a first direction and the drive pin extends in a second direction without an additional step of bending the integral unit.

The diaphragm is sandwiched between the first housing part and the second housing part whereby a separate attachment structure, e.g. in the form of cams and/or recesses, for attaching the diaphragm in the inner space may be omitted. Thus, a circumferential edge part of the diaphragm is arranged in a joint between the first housing part and the second housing part in the closed configuration. Furthermore, a separate sealing between a front volume and a back volume may be omitted, as the diaphragm when sandwiched between the housing parts may ensure that the volumes are separated from each other. By the omission of a separate attachment structure, the void space in the inner space may be increased.

In one embodiment, a static part of the diaphragm may provide attachment of the diaphragm to the receiver housing by arranging the static part forming a circumferential edge part of the diaphragm in a joint between the first housing part and the second housing part in the closed configuration. Thus, the wall thickness of the first and second housing part may be used a support structure of the static part forming a frame for the diaphragm.

The receiver assembly may further comprise a support structure for strengthening at least a part of the first and/or second housing part. The support structure may be in the form of a flange arranged circumferential relative to the first and/or second housing part. This may be particularly relevant if the wall thickness of the first and/or second housing part is too low to support the diaphragm.

If the diaphragm is made of a ferromagnetic material such as nickel, magnetic leakage may be avoided or at least considerably reduced.

The receiver assembly may further comprise a magnet assembly configured to provide a magnetic field in a gap. The gap may be an air gap or a gap filed with a substance, such as ferromagnetic fluids, depending on the transducer technology in which the magnet assembly is to be used. The armature may extend in the first direction in the gap.

The drive pin and the armature may comprise a bent transition portion, where the armature may extend in the first direction from the transition portion and the drive pin may extend in the second direction from the transition portion. The bent transition portion may as an example be formed by moulding or by bending of the integral unit forming the armature and the drive pin.

In the context of the present invention, three directions can be used to describe the integral unit. An X-direction which corresponds to the extent of the armature in the first direction; i.e. the X-direction and the first direction are identical. The dimension of the armature in the X-direction may be designated "the length". A Z-direction which defines a line extending perpendicular to the X-direction. The dimension of the armature in the Z-direction may be designated "the thickness". A Y-direction which is perpendicular to both the Z- and the X-directions. The dimension of the armature in the Y-direction may be designated "the width".

Thus, the armature may have a thickness being perpendicular to the first direction and transverse to first direction. The thickness of the armature may in one embodiment be at least 20 percent larger than a thickness of the drive pin. It should however be understood, that the thickness of the armature and the drive pin may be identical, e.g. in embodiments where the process of manufacturing the integral unit comprises a step of bending the integral unit.

The manufacturing process may however also comprise a step of flattening the drive pin. In the context of the present invention the term "flattening" should be understood as a process of reducing the thickness of the drive pin. The may be achieved by exerting a pressure on the drive pin, e.g. in a coining process step. Subsequently, excess material deriving from the flattening process may be removed by a stamping process during which the integral unit; i.e. the armature and the drive pin may achieve their final shape. It should be understood that the flattening step and/or the stamping process may be repeated.

As flattening of the drive pin may facilitate bending of the integral unit, the step of flattening the drive pin may be carried out before bending the integral unit. It should however be understood, that a step of flattening the drive pin may also be carried out after bending the integral unit.

Furthermore, flattening of the drive pin may facilitate joining of the drive pin and the diaphragm. In embodiment where the drive pin is received in an opening in the diaphragm, this hole may be smaller than if the drive pin is not flattened.

A flattened drive pin may provide more void space in the receiver housing, a lighter receiver assembly, and less magnetic contact between the armature and the magnet assembly. A flattened drive pin may further allow for a smaller bend radius of the bend transition portion, and may thus provide a shorter receiver assembly.

The armature may have a width being perpendicular to the first direction and along the first direction, i.e. in the Y-direction. The width of the armature may be at least twice a width of the drive pin, such as three times the width, such as four times the width, or even more.

In one embodiment, the armature may comprise a first tapered section, whereby the width of the armature decreases toward the bend transition portion. This may increase the high frequency output due to the lowered weight compared to an armature without a tapered section.

Furthermore, the armature may comprise a second tapered section, whereby the thickness of the armature decreases toward the bend transition portion. This may also increase the high frequency output due to the lowered weight compared to an armature without a tapered section. Compared to a first tapered section decreasing the width, this has the advantage that the magnetic area under the magnet is not reduced.

It should be understood, that the first tapered section and the second tapered section may be alternative ways of constructing the armature. However, it should further be understood, that in one embodiment, the armature may comprise both a first tapered section and a second tapered section.

The drive pin itself may comprise a bent section along the length of the drive pin. The drive pin may extend substantially in the Z-direction, and the bent section may be in the Y- and/or X-direction. A bent section on the drive pin may create an extra resonance frequency.

It should be understood, that the drive pin may comprise a plurality of bent sections.

In one embodiment, the receiver assembly may comprise a second drive pin. The second drive pin may be arranged parallel to the drive pin, and may be formed in one part with the armature. It should however be understood, that the second drive pin may be a separate element which may subsequently be attached to the armature. The use of two drive pins may increase the torsional stability of the diaphragm.

The drive pin may be attached to the diaphragm via an opening in the diaphragm. The drive pin may be attached to the diaphragm by use of an adhesive. The adhesive may further seal the opening whereby communication between the front volume and the back volume through the drive pin opening in the diaphragm may be avoided. In embodiments also comprising a second drive pin, the second drive pin may be attached to the diaphragm at a second position, e.g. via a second opening.

The receiver assembly may comprise a magnet assembly comprising a magnet and a magnet shell. The magnet shell may form an inner space in which one or more magnets are provided. However, as positioning of the magnet(s) may be difficult due to the size and due to requirements and tolerance relating to the magnetic interface, the magnet shell may comprise at least two shell parts forming an inner surface substantially encircling the inner space.

The at least two shell parts may be attached to each other by welding. The magnet(s) may be attached to the shell parts by gluing or welding. It should however be understood that other means of attachment may also be used, such as clamping, screwing or by used of a pinhole, etc.

By providing the magnet shell by at least two shell parts it may be possible to attached the magnet to at least one of the shell parts before assembling the magnet shell, thereby facilitating the assembling procedure.

The magnet shell may comprise a protecting layer arranged on the outer surface of the magnet shell. The protecting layer, e.g. a copper layer, may be arranged to reduce electromagnetic radiation from the magnet assembly. The protecting layer may be arranged on the outer surface of the magnet shell after assembling of the at least two shell parts.

At least one of the first and second housing parts may comprise at least one opening to allow one or more wires to extend from outside the inner space into the inner space. However, in one embodiment, at least one of the first housing part and the second housing part may additionally or alternatively comprise at least one depression/recess formed at an edge portion to form an opening between the first housing part and the second housing part in the closed configuration. The depression(s)/recess(es) may be formed by exerting a pressure at the edge portion at the required position. Alternatively, the depression(s)/recess(es) may be formed as part of a moulding process when manufacturing at least one of the first and second housing parts.

The application of one or more depressions may lower the risk of damaging the wires when running a wire from the inner space to the outside of the receiver housing. Damaging traditionally occurs when scratching a wire against an inner surface of openings provided in one of the first and second housing parts.

The receiver assembly may further comprise a compressible dampening element arranged in the gap provided by the magnet assembly. The compressible dampening element may reduce the risk of collision between the armature and the magnet(s), and may thereby acts as shock protection. The dampening element may comprise protrusions on the armature and/or on the magnet(s).

In embodiments comprising dampening element(s) on the armature, it may be an advantage if the dampening element (s) is(are) arranged at a distance from the drive pin to thereby better reduce movement of the armature.

The dampening element(s) may comprise simple glue drops and/or plates. Other types of dampening elements may however also be used. As an example, two, four, or even more dampening elements may be arrange in the gap.

The dampening element may thus limit large deflection of the armature and may additionally be configured to cushion the armature during shock. U.S. Pat. No. 6,658,134 discloses shock protection for a transducer.

The receiver assembly may further comprise an acoustical venting opening connecting the inner space to an exterior volume outside the receiver housing. The acoustical venting opening may form an acoustical passage at least through the diaphragm.

The diaphragm may comprise a movable part and a static part, such as a frame part. In one embodiment, the acoustical venting opening is positioned in the static part of the diaphragm.

By arranging a venting opening through the diaphragm, it may be possible to boost the low-frequency response of the receiver assembly.

According to a second aspect, the invention provides a personal audio device comprising a receiver assembly according to the first aspect of the invention.

It should be understood, that a skilled person would readily recognise that any feature described in combination with the first aspect of the invention could also be combined with the second aspect of the invention, and vice versa.

According to a third aspect, the invention provides a method of assembling a receiver assembly according to the first aspect of the invention, the method comprising the steps of:

providing a receiver housing, the receiver housing comprising a first housing part and a second housing part, the receiver housing defining an inner space, wherein the first housing part and the second housing part are movable relative to each other to define an open configuration and a closed configuration, providing a magnet assembly configured to provide a magnetic field in an air gap, providing an integral unit forming an armature and a drive pin, the integral unit being formed in one piece, providing a diaphragm, arranging the integral unit so that at least a part of the armature extends in a first direction in the air gap, bending the integral unit to form a bent transition portion, so that the armature extends in the first direction from the transition portion and the drive pin extends in a second direction from the transition portion, the first and second directions being different, arranging a circumferential edge part of the diaphragm along an edge portion of one of the first housing part and the second housing part, and joining the first housing part and the second housing part so that the circumferential edge portion of the diaphragm is located in a joint between the first housing part and the second housing part.

The method may further comprise a step of attaching the drive pin to the diaphragm. The step of attaching the drive pin to the diaphragm may be carried out after the step of bending the integral unit.

It should be understood, that a skilled person would readily recognise that any feature described in combination with the first aspect and the second aspect of the invention could also be combined with the third aspect of the invention, and vice versa.

The receiver assembly according to the first aspect of the invention and the personal audio device according to the second aspect of the invention are very suitable in relation to performing the method steps according to the third aspect of the invention. The remarks set forth above in relation to the receiver assembly and the personal audio device are therefore equally applicable in relation to the method.

According to a fourth aspect, the invention provides a method of assembling a receiver assembly, the method comprising the steps of:

providing a receiver housing, the receiver housing comprising a first housing part and a second housing part, arranging a circumferential edge part of the diaphragm along an edge portion of one of the first housing part and the second housing part, and joining the first housing part and the second housing part so that the circumferential edge portion of the diaphragm is located in a joint between the first housing part and the second housing part.

It should be understood, that a skilled person would readily recognise that any feature described in combination with the first aspect and the second aspect of the invention could also be combined with the fourth aspect of the invention, and vice versa.

The receiver assembly according to the first aspect of the invention and the personal audio device according to the second aspect of the invention are very suitable in relation to performing the method steps according to the fourth aspect of the invention. The remarks set forth above in relation to the receiver assembly and the personal audio device are therefore equally applicable in relation to the method.

According to a fifth aspect, the invention provides a receiver assembly comprising:

a receiver housing comprising a first housing part and a second housing part, the receiver housing defining an inner space, wherein the first housing part and the second housing part are movable relative to each other to define an open configuration and a closed configuration, a diaphragm, and an acoustical venting opening connecting the inner space to an exterior volume outside the receiver housing, the acoustical venting opening forming an acoustical passage at least through the diaphragm.

The diaphragm may comprise a movable part and a static part, such as a frame part. In one embodiment, the acoustical venting opening is positioned in the static part of the diaphragm.

It should be understood, that a skilled person would readily recognise that any feature described in combination with the first, second, third, and fourth aspects of the invention could also be combined with the fifth aspect of the invention, and vice versa.

According to a sixth aspect, the invention provides a method of assembling a receiver assembly according to the first aspect of the invention, the method comprising the steps of:

providing an armature, providing a magnet assembly configured to provide a magnetic field in an gap, providing a coil with at least one wire, the coil defining a coil tunnel, arranging the armature so that extends in a first direction in the gap and in the coil tunnel, providing a receiver housing, the receiver housing comprising a first housing part and a second housing part, where at least one depression is formed at an edge portion of the second housing part, and arranging the armature, magnet assembly and the coil in the second housing part to that the at least one wire is arranged in the at least one depression.

It should be understood, that a skilled person would readily recognise that any feature described in combination with the first, second, third, fourth, and fifth aspects of the invention could also be combined with the sixth aspect of the invention, and vice versa.

According to a seventh aspect, the invention provides a receiver assembly comprising:

a receiver housing comprising a first housing part and a second housing part, the receiver housing defining an inner space, wherein the first housing part and the second housing part are movable relative to each other to define an open configuration and a closed configuration, an armature extending in a first direction in the inner space, a diaphragm operationally attached to the armature via a drive pin extending in a second direction, the first and second directions being different, wherein a circumferential edge part of the diaphragm is arranged in a joint between the first housing part and the second housing part in the closed configuration.

The armature and the drive pin may be formed in one part as described above. It should however be understood, that the receiver assembly may also comprise an armature and a drive pin formed as two separate parts.

It should be understood, that a skilled person would readily recognise that any feature described in combination with the first, second, third, fourth, fifth, and sixth aspects of the invention could also be combined with the seventh aspect of the invention, and vice versa.

BRIEF DESCRIPTION OF THE DRAWINGS

Embodiments of the invention will now be further described with reference to the drawings, in which.

DETAILED DESCRIPTION OF THE DRAWINGS

It should be understood that the detailed description and specific examples, while indicating embodiments of the invention, are given by way of illustration only, since various changes and modifications within the spirit and scope of the invention will become apparent to those skilled in the art from this detailed description.

Figure 1:
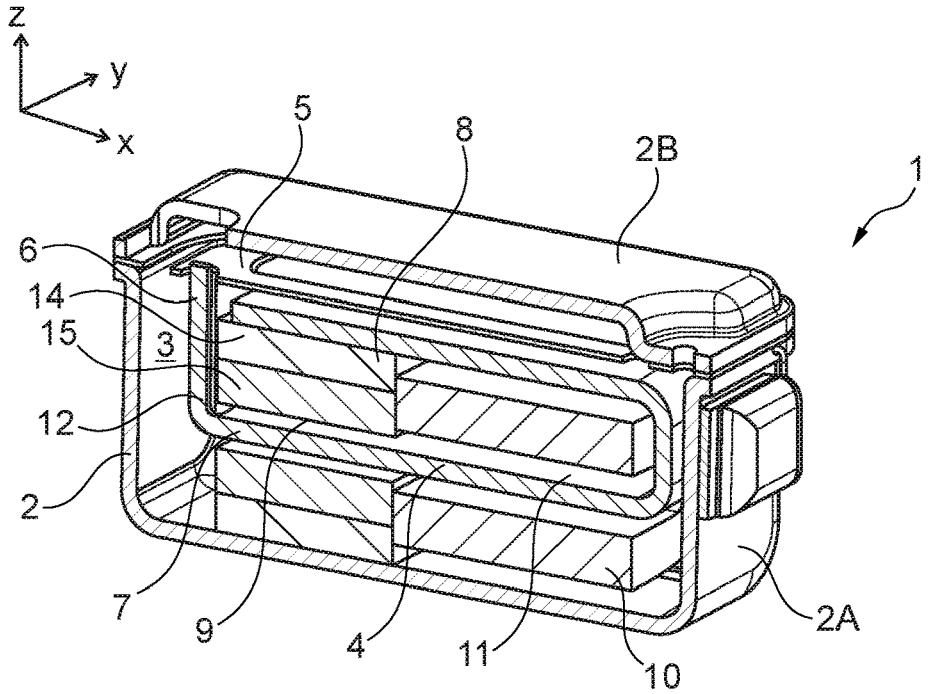
FIG. 1 illustrates a cross-section through an embodiment of a receiver assembly.

FIG. 1 illustrates a cross-section through an embodiment of a receiver assembly 1. The receiver assembly 1 comprises a receiver housing 2 which comprises a first housing part 2A and a second housing part 2B. The receiver housing 2 defines an inner space 3. The first housing part 2A and the second housing part 2B are movable relative to each other to define an open configuration and a closed configuration. In the illustrated embodiment, the receiver housing defines a closed configuration.

The receiver assembly 1 further comprises an armature 4 extending in a first direction in the inner space 3, and a diaphragm 5 operationally attached to the armature 4 via a drive pin 6 which extends in a second direction. The drive pin 6 and the armature 4 are formed in one part thereby forming an integral unit 7.

Three directions can be used to describe the integral unit 7. An X-direction which corresponds to the extent of the armature in the first direction; i.e. the X-direction and the first direction are identical. The dimension of the armature in the X-direction may be designated "the length". A Z-direction which defines a line extending perpendicular to the X-direction. The dimension of the armature in the Z-direction may be designated "the thickness". A Y-direction which is perpendicular to both the Z- and the X-directions. The dimension of the armature in the Y-direction may be designated "the width".

The illustrated receiver assembly 1 further comprise a magnet assembly 8 configured to provide a magnetic field in the gap 9 in which the armature 4 extends.

Furthermore, the illustrated receiver assembly 1 comprises a coil 10 which may comprise a number of windings defining a coil tunnel 11 through which the armature 4 extends. The coil tunnel 11 and the gap 9 are arranged adjacent to each other so that the armature 4 can extend though both the coil tunnel and the air gap.

The drive pin 6 and the armature 4 comprises a bent transition portion 12, where the armature 4 extends in the first direction from the transition portion 12 and the drive pin 6 extends in the second direction from the transition portion 12.

In the illustrated embodiment, the angle between the first direction and the second direction is approximately 90 degrees.

The diaphragm 5 is sandwiched between the first housing part 2A and the second housing part 2B. Thus, a circumferential edge part of the diaphragm 5 is arranged in a joint between the first housing part 2A and the second housing part 2B in the closed configuration.

Figure 2:
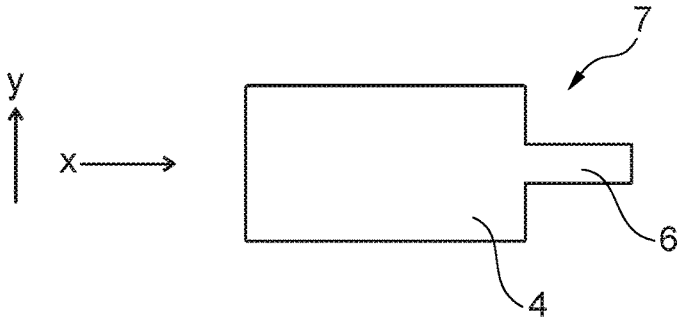
FIG. 2 illustrates an embodiment of an armature and a drive pin formed in one part.

FIG. 2 illustrates a simple embodiment of an armature 4 and a drive pin 6 formed in one part; i.e. as an integral unit 7. The armature 4 is an elongated element where a drive pin 6 is formed at one end portion. The width; i.e. the size in the Y-direction, of the armature 4 is wider than the width of the drive pin 6.

Figure 3:
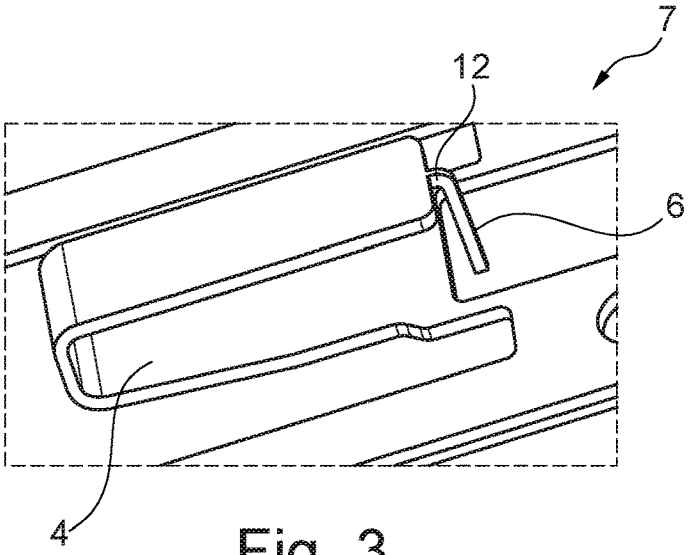
FIG. 3 illustrates a section of an embodiment of an armature and a drive pin formed in one part.
Figure 4:
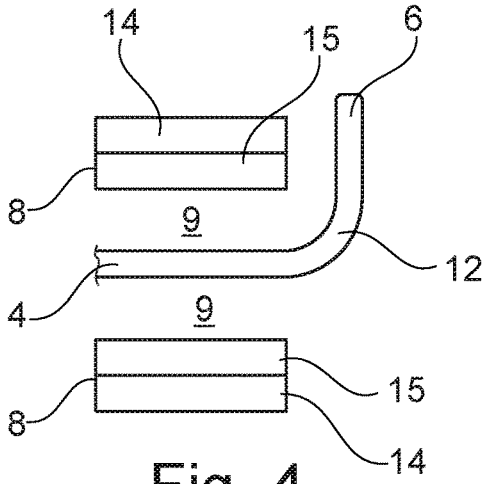
FIG. 4 illustrates an embodiment of an armature and a drive pin formed in one part.

FIG. 3 illustrates a section of an embodiment of a U-shaped armature 4 and a drive pin 6 formed in one part, and forming a bent transition portion 12 from which the armature 4 and the drive pin 6 extend in different directions.

FIGS. 4-9 illustrate different embodiments of an armature 4 and a drive pin 6 formed in one part, and extending in two different directions from the bent transition portion 12. In each of the embodiments illustrated in FIGS. 5-9, the drive pin 6 itself comprises a bent section 13. The bent section 13 is arranged at different positions along the length of the drive pin 6.

The receiver assembly comprises in each of the embodiments a magnet assembly 8 configured to provide a magnetic field in a gap 9. The armature 4 extends in the first direction in the gap 9. The magnet assembly 8 comprises a magnet shell 14 and at least one magnet 15.

Figure 5:
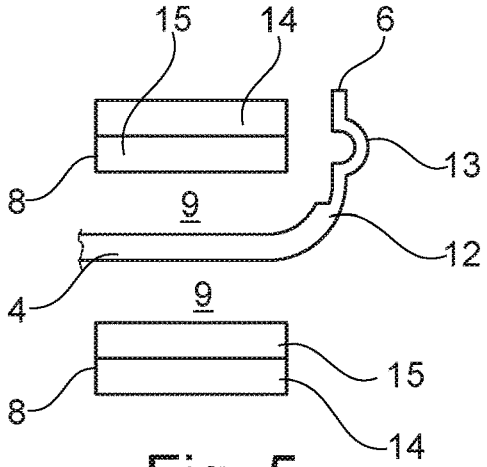
FIG. 5 illustrates an embodiment of an armature and a drive pin formed in one part.

In the embodiment illustrated in FIG. 5, the bent section 13 is located substantially at the middle section of the drive pin 6. The bent section 13 is substantially C-shaped and extends in the X-direction and along the Z-direction.

Figure 6:
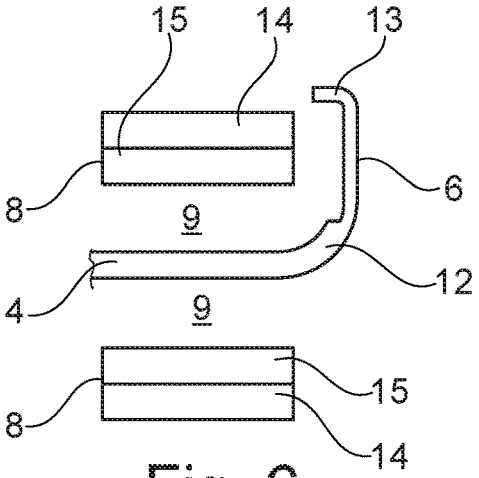
FIG. 6 illustrates an embodiment of an armature and a drive pin formed in one part.

In the embodiment illustrated in FIG. 6, the bent section 13 is at the free end of the drive pin 6. The bent section 13 extends substantially 90 degrees relative to the drive pin 6 and extends in the X-direction. The thickness of the drive pin 6 is smaller than the thickness of the armature, such as approximately half the thickness.

Figure 7:
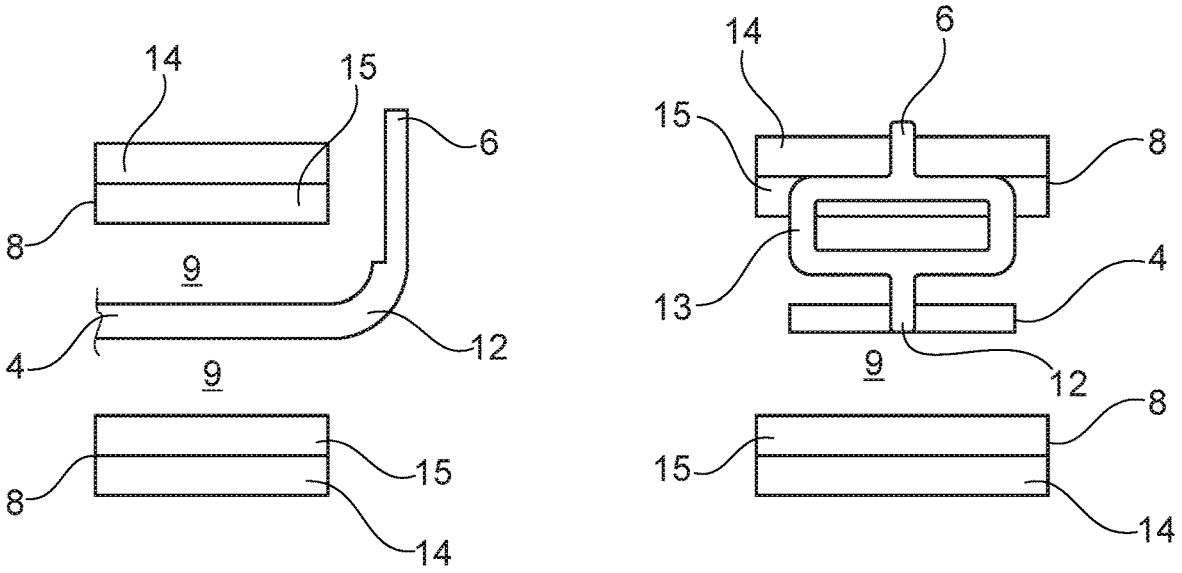
FIG. 7 illustrates an embodiment of an armature and a drive pin formed in one part.

In the embodiment illustrated in FIG. 7, the bent section 13 extends in the Y-direction and is formed as a closed loop at the middle section of the drive pin 6 which is illustrated in the right side part of FIG. 7 being an end view of the embodiment also illustrated in the left side part of FIG. 7.

Figure 8:
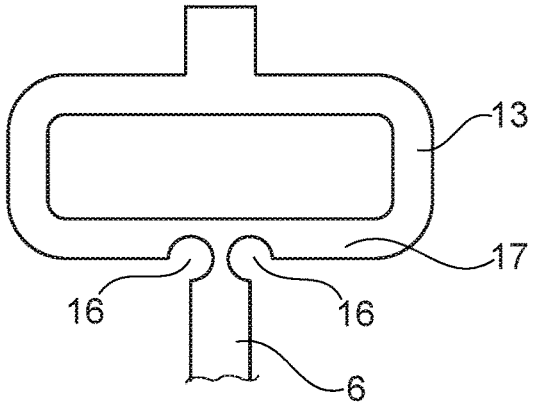
FIG. 8 illustrates a section of an embodiment of an armature and a drive pin formed in one part.

FIG. 8 illustrates a bent section 13 similar to the bent section illustrated in FIG. 7. However, the undercuts 16 at the lower portion 17 of the bent section 13 will reduce the mass of the drive pin 6 and thereby tune the resonance frequency. Furthermore, the compliance of the drive pin 6 is changed.

Figure 9:
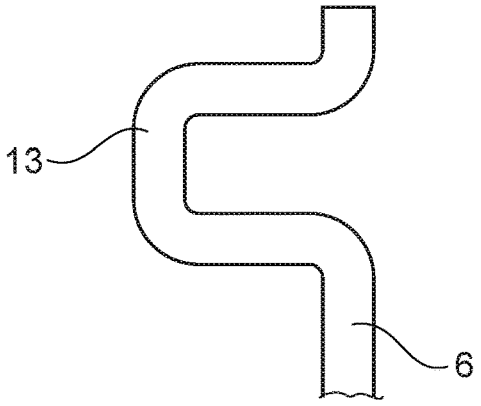
FIG. 9 illustrates a section of an embodiment of an armature and a drive pin formed in one part.

In the embodiment illustrated in FIG. 9, the bent section 13 is located substantially at the middle section of the drive pin 6. The bent section 13 is substantially C-shaped and extends in the Y-direction. Thus, the bent section 13 is similar to the bent section illustrated in FIG. 5.

Figure 10:
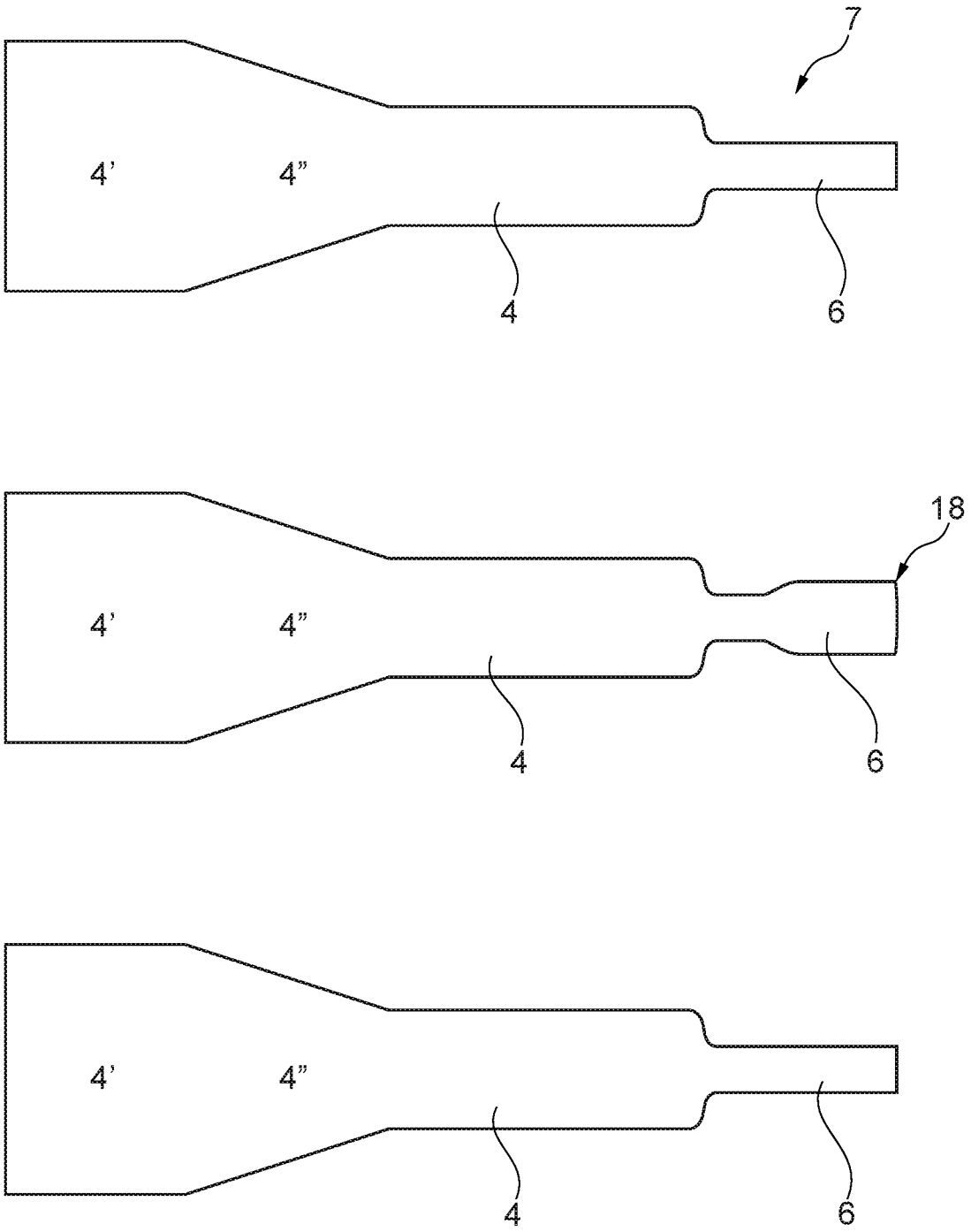
FIG. 10 illustrates an embodiment of an armature and a drive pin formed in one part at different steps of the manufacturing hereof.

FIG. 10 illustrates an embodiment of an armature 4 and a drive pin 6 formed in one part at different steps of the manufacturing hereof. The armature 4 is a U-shaped armature which is initially stamped out of a piece of sheet metal. The second part 4' will subsequently be bent to form a second leg, whereas the first part 4 will form the first leg which should extend in the first direction through the gap 9. The transition section 4" will form the lower part of the U thereby connecting the two legs 4, 4' of the armature. After bending of the armature, the first part 4 will be parallel to the second part 4' thereby forming two parallel legs of the U-shaped armature, where the first leg part 4 and the second leg part 4' are connected by the transition section 4".

In the upper part of FIG. 10, the armature 4, 4', 4" and the drive pin 6 has been stamped out of the sheet metal. In the middle part of FIG. 10, the drive pin 6 has been flattened by coining the drive pin part of the integral unit 7. The area of the drive pin 6 has been increased due to the flattening and the circumferential edge 18 of the drive pin 6 is non-uniform.

In the lower part of FIG. 10, a second stamping step has been carried out to remove the excess material from the drive pin 6 and to provide a drive pin 6 with a well-defined edge 18.

Figure 11:
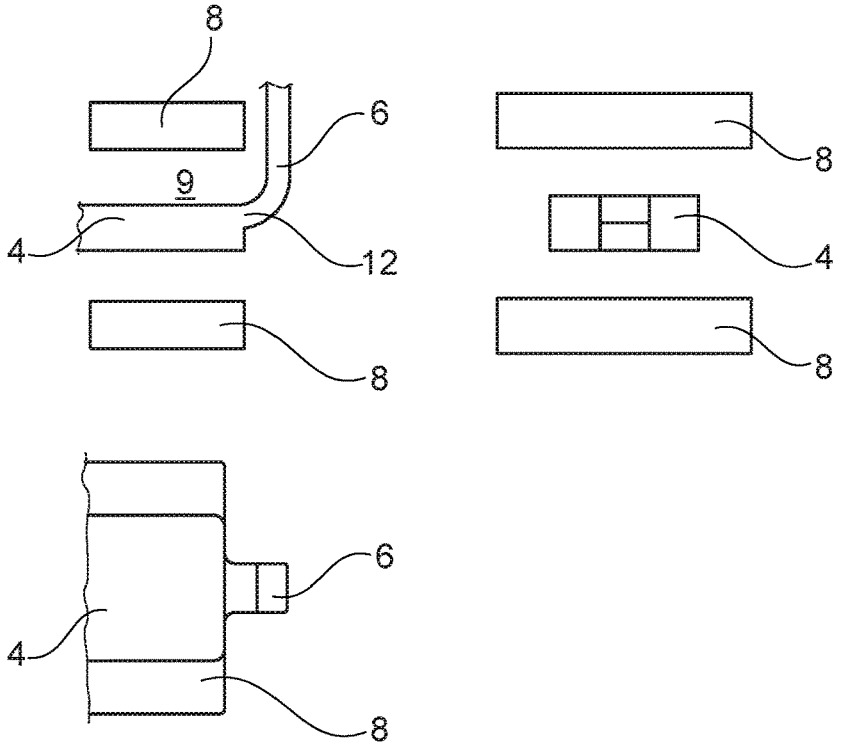
FIG. 11 illustrates an embodiment of an armature and a drive pin formed in one part at different views.
Figure 12:
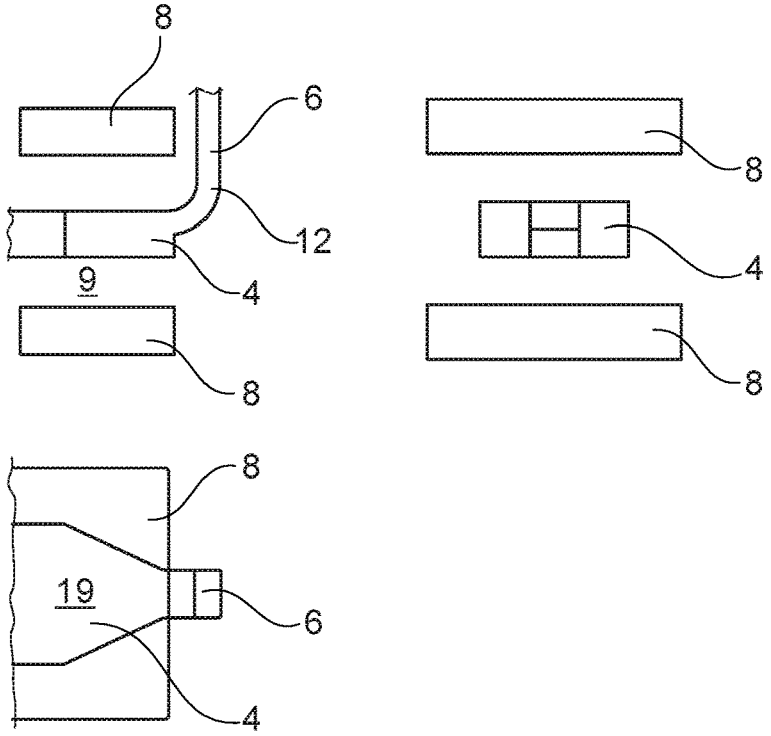
FIG. 12 illustrates an embodiment of an armature and a drive pin formed in one part at different views.
Figure 13:
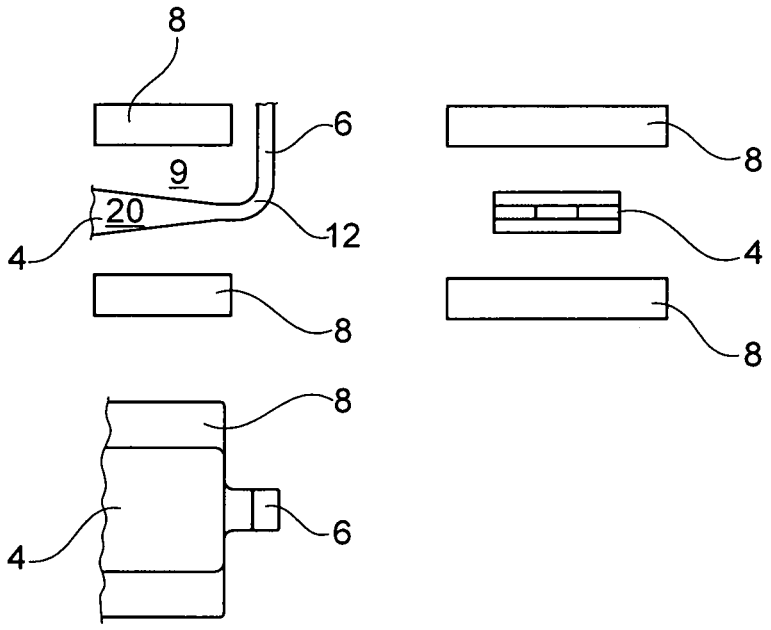
FIG. 13 illustrates an embodiment of an armature and a drive pin formed in one part at different views.

FIGS. 11-13 illustrate different embodiments of an armature 4 and a drive pin 6 formed in one part. The armature 4 extends in a first direction (the X-direction) through the gap 9 from the bent transition part 12, and the drive pin 6 extends in a second direction (the Z-direction) from the bent transition part 12.

The drive pin 6 illustrated in FIG. 11 (in three different views) is flattened by the flattening process illustrated in FIG. 10 whereby the thickness of the drive pin 6 is smaller than the thickness of the armature.

The drive pin 6 illustrated in FIG. 12 (in three different views) is also flattened by the flattening process illustrated in FIG. 10. Furthermore, the armature 4 comprises a first tapered section 19, whereby the width of the armature 4 decreases toward the bend transition portion 12.

The drive pin 6 illustrated in FIG. 13 (in three different views) is also flattened by the flattening process illustrated in FIG. 10. Furthermore, the armature 4 comprises a second tapered section 20, whereby the thickness of the armature 4 decreases toward the bend transition portion 12. Compared to the first tapered section 19 decreasing the width illustrated in FIG. 12, this has the advantage that the magnetic area under the magnet (not shown) in the magnet assembly 8 is not reduced.

Figure 14A:
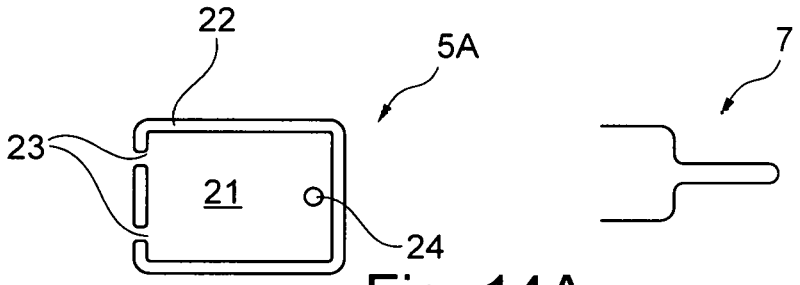
FIG. 14A illustrates a different embodiment of a diaphragm 5A and an integral unit 7.
Figure 14B:
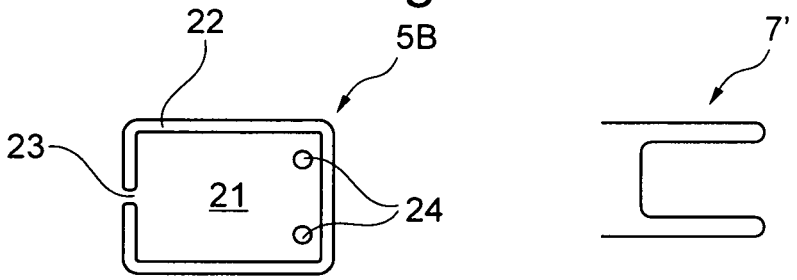
FIG. 14B illustrates a different embodiment of a diaphragm 5B and an integral unit 7'.
Figure 14C:
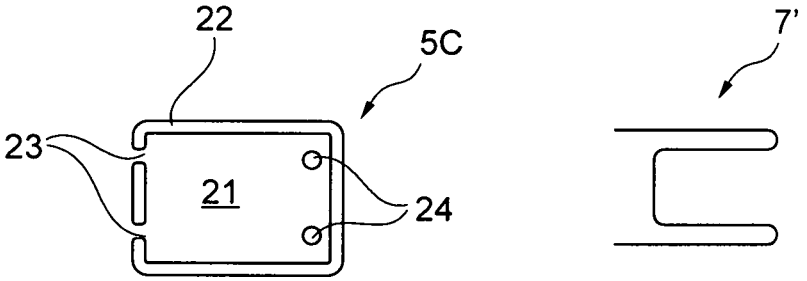
FIG. 14C illustrates a different embodiment of a diaphragm 6C and an integral unit 7'.

FIGS. 14A-14C illustrate different embodiments of a diaphragm 5A, 5B, 5C and different embodiments of an integral unit 7, 7' comprising an armature 4 and one or two drive pins 6.

The diaphragms 5A, 5B, 5C comprise a movable part 21 and a static part 22. The static part 22 is configured for attachment of the diaphragm 5 to the receiver housing 2. The static part 22 at least party circumferences the movable part 21 of the diaphragm 5.

In the upper and lower embodiments, the diaphragms 5A, 5C are hinged to the receiver housing (not shown) by two hinges 23, whereas the diaphragm 5B is only hinged to the housing by a single hinge 23.

In the upper embodiment, the integral unit 7 comprises a single drive pin 6, whereas the integral unit 7' in the two lower embodiments comprises two drive pins 6 arranged in parallel.

The drive pin (s) 6 is(are) attached to the diaphragm 5 via the openings 24.

Figure 15A:
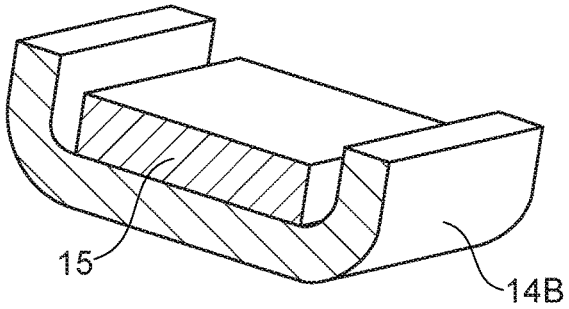
FIGS. 15A-15B illustrate an embodiment of a magnet shell.
Figure 15B:
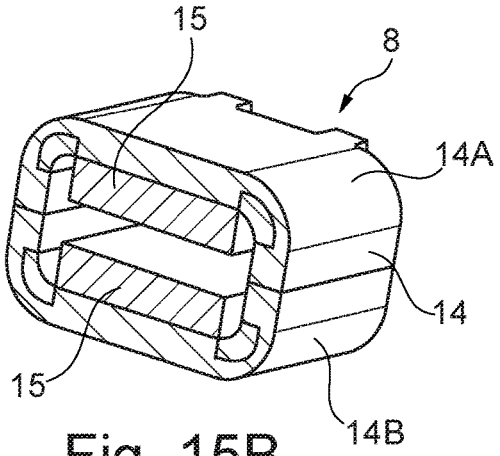

FIGS. 15A-15B illustrate an embodiment of a magnet assembly 8 comprising a magnet shell 14 and a magnet 15. The magnet shell 14 forms an inner space in which the magnets 15 are provided. In the illustrated embodiment, the magnet shell 14 comprises two shell parts 14A, 14B forming an inner surface substantially encircling the inner space. The two shell parts 14A, 14B is attached to each other by welding after positioning and attaching the magnet 15. The magnet 15 are attached to the shell parts by gluing.

Figure 16A:
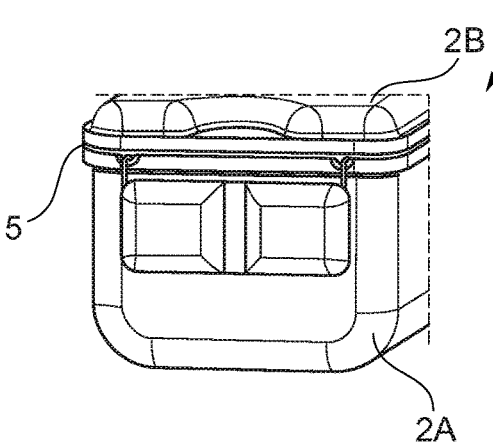
FIGS. 16A-16B illustrate details of an embodiment of a receiver assembly.
Figure 16B:
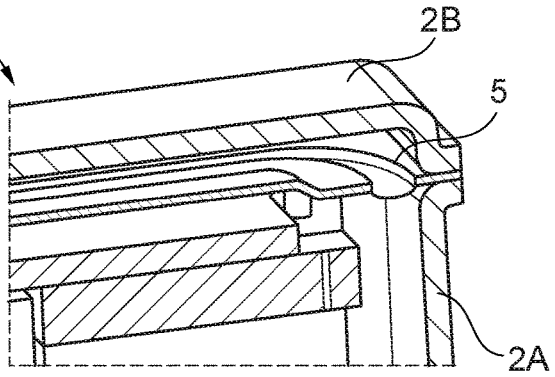

FIGS. 16A-16B illustrate details of an embodiment of a receiver assembly 1. The diaphragm 5 is sandwiched between the first housing part 2A and the second housing part 2B whereby a separate attachment structure, e.g. in the form of cams and/or recesses, for attaching the diaphragm in the space may be omitted. A circumferential edge part of the diaphragm 5 is arranged in the joint between the first housing part 2A and the second housing part 2B.

Figure 17A:
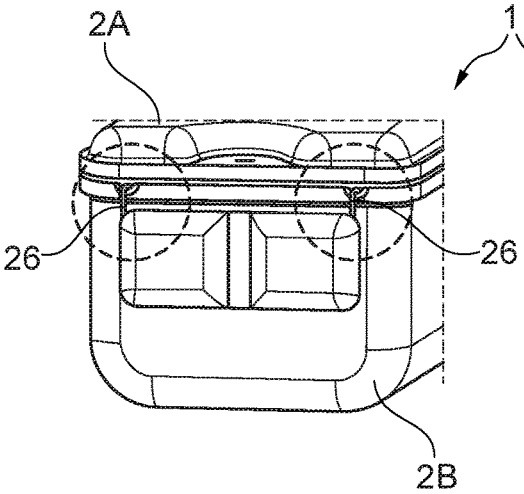
FIGS. 17A-17B illustrate details of an embodiment of a receiver assembly.
Figure 17B:
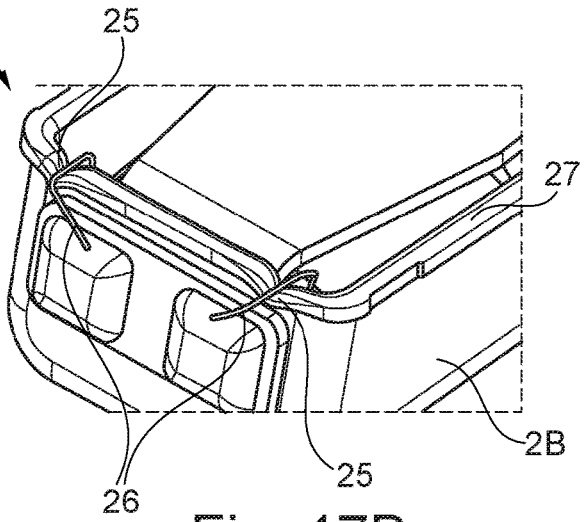

FIGS. 17A-17B illustrate details of an embodiment of a receiver assembly 1. The second housing part 2B comprises two depressions 25 formed at an edge portion 27 to form an opening between the first housing part 2A and the second housing part 2B in the closed configuration. The depressions 25 are formed as part of a moulding process when manufacturing the second housing part 2B. The application of the depressions 25 lower the risk of damaging the wires 26 when running wires 26 from the inner space 3 to the outside of the receiver housing 2.

The following figures illustrate different steps from a method of manufacturing an embodiment of a receiver assembly 1. It should be understood, that not all steps will be present in all methods, as the different embodiments may differ both in process steps and in elements comprised. It should furthermore be understood that the described method steps may only be some of the manufacturing steps as at least some methods may comprises additional and/or alternative steps.

Figure 18A:
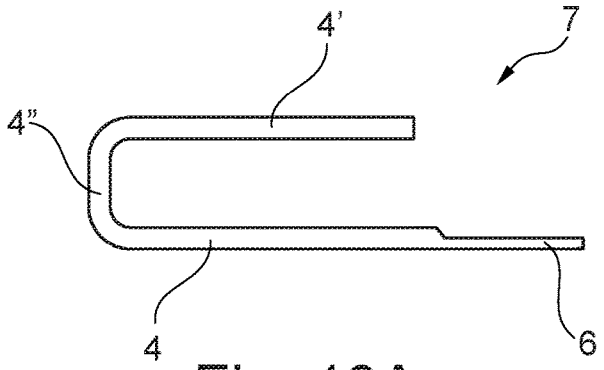
FIGS. 18A-18B illustrate different views of a first step of manufacturing a receiver assembly.
Figure 18B:
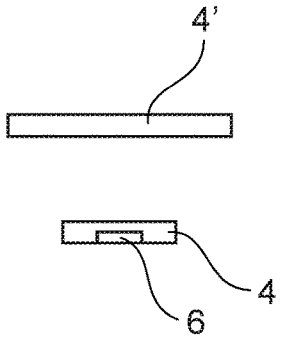

FIGS. 18A-18B illustrate different views of a first step of manufacturing a receiver assembly 1. During the first step, the drive pin 6 is flattened, and the armature 4 is bended to form a U-shaped armature. FIG. 18B is an end view of FIG. 18A being a side view of the integral unit 7 comprising an armature 4 and a drive pin 6 formed in one part.

Figure 19A:
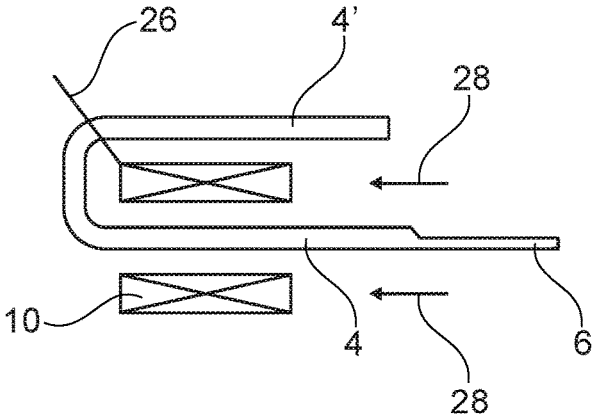
FIGS. 19A-19B illustrate different views of a second step of manufacturing a receiver assembly.
Figure 19B:
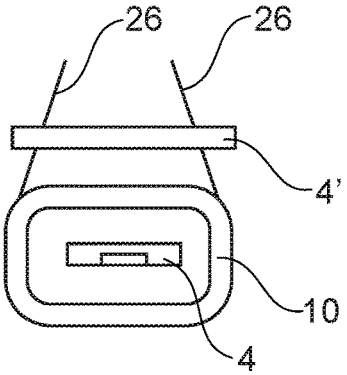

FIGS. 19A-19B illustrate different views of a second step of manufacturing a receiver assembly 1. During the second step, the coil 10 with wires 26 is arranged around the first leg of the armature 4 by moving it along the armature as illustrated by the arrows 28.

Figure 20A:
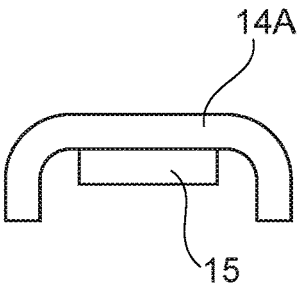
FIGS. 20A-20B illustrate different views of a third step of manufacturing a receiver assembly.
Figure 20B:
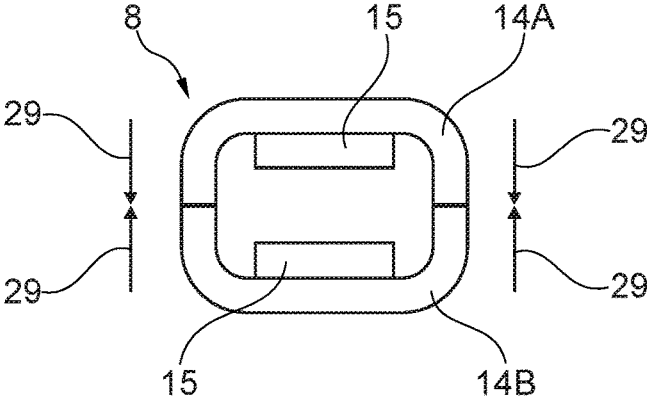

FIGS. 20A-20B illustrate different views of a third step of manufacturing a receiver assembly 1. During the third step, the magnets 15 are arranged in and attached to the magnet shell parts 14A, 14B. Subsequently, the magnet shell parts 14A, 14B are joined to form the assembled magnet shell 14, and thereby the magnet assembly 8 as illustrated by the arrows 29.

Figure 21:
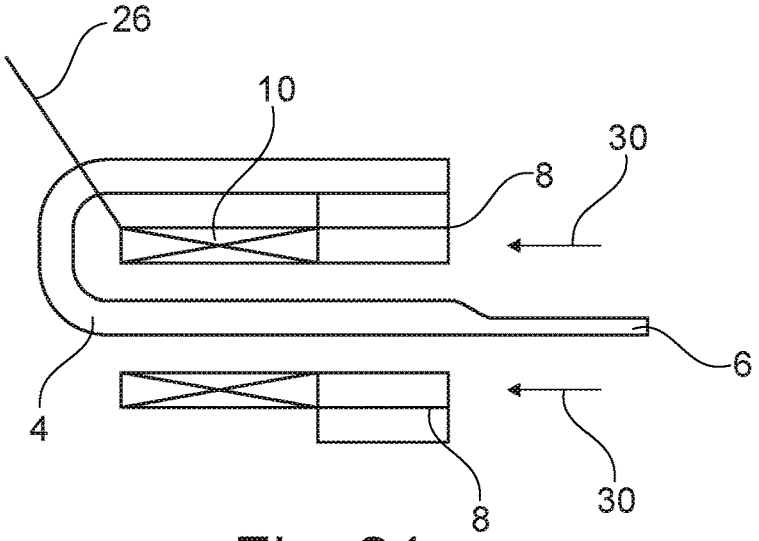
FIG. 21 illustrates a fourth step of manufacturing a receiver assembly, FIG. 22 illustrate a fifth step of manufacturing a receiver assembly.

FIG. 21 illustrates a fourth step of manufacturing a receiver assembly 1. During the fourth step, the magnet assembly 8 is arranged around the first leg of the armature 4 by moving it along the armature as illustrated by the arrows 30. The magnet assembly 8 is arranged adjacent to the coil 10.

Figure 22:
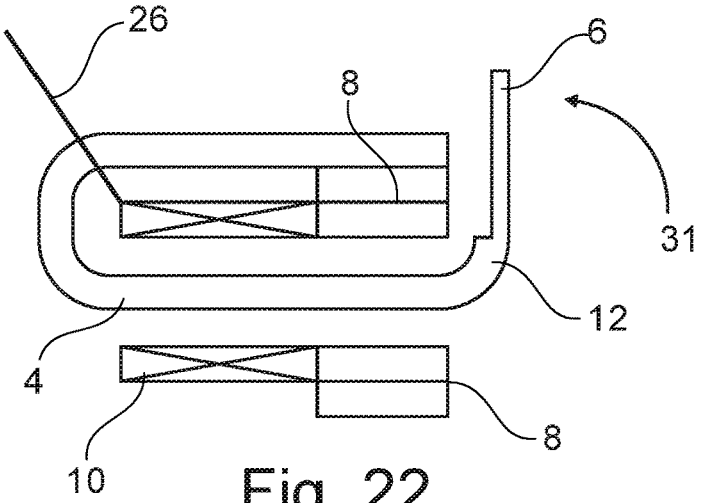

FIG. 22 illustrate a fifth step of manufacturing a receiver assembly 1. During the fifth step, the integral unit 7 is bended as illustrated by the arrow 31 to form a bend transition portion 12 from which the armature 4 extends in a first direction (the X-direction) and the drive pin 6 extends in a second direction (the Z-direction). In the illustrated embodiment, the angle between the first and second direction is substantially 90 degrees.

Figure 23A:
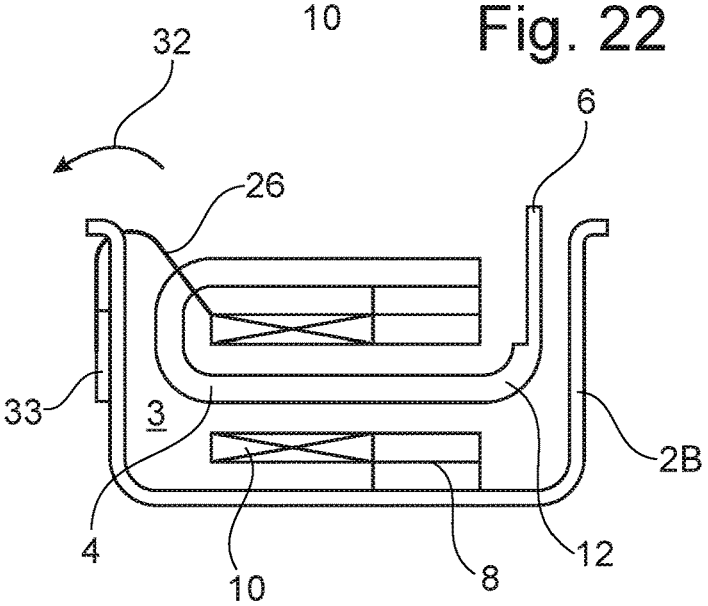
FIGS. 23A-23B illustrate different views of a sixth step of manufacturing a receiver assembly.
Figure 23B:
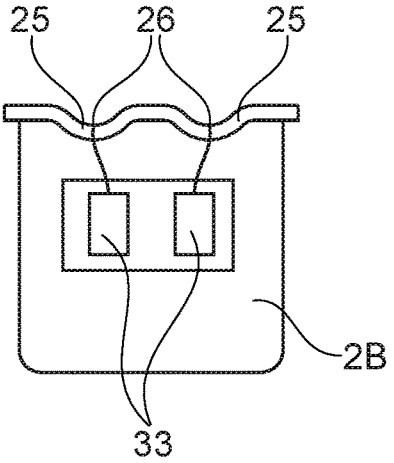

FIGS. 23A-23B illustrate different views of a sixth step of manufacturing a receiver assembly 1. During the sixth step, the armature 4, the drive pin 6, the coil 10, and the magnet assembly 8 are arranged in the second housing part 2B and the wires 26 are run from the inner space 3 to the outside of the receiver housing 2 as illustrated by the arrow 32. The wires 26 are arranged in the depression 25 in the transition from the inner space to the outside of the receiver assembly. A free end of each of the wires 26 is attached to the prints 33 on the outside of the second housing part 2B.

Figure 24:
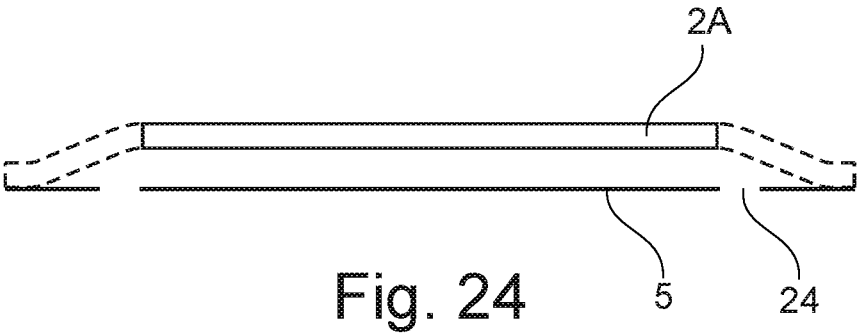
FIG. 24 illustrates a seventh step of manufacturing a receiver assembly.

FIG. 24 illustrates a seventh step of manufacturing a receiver assembly 1. In the seventh step, the first housing part 2A is prepared by attaching the diaphragm 5 to the lower side surface of the first housing part 2A.

Figure 25:
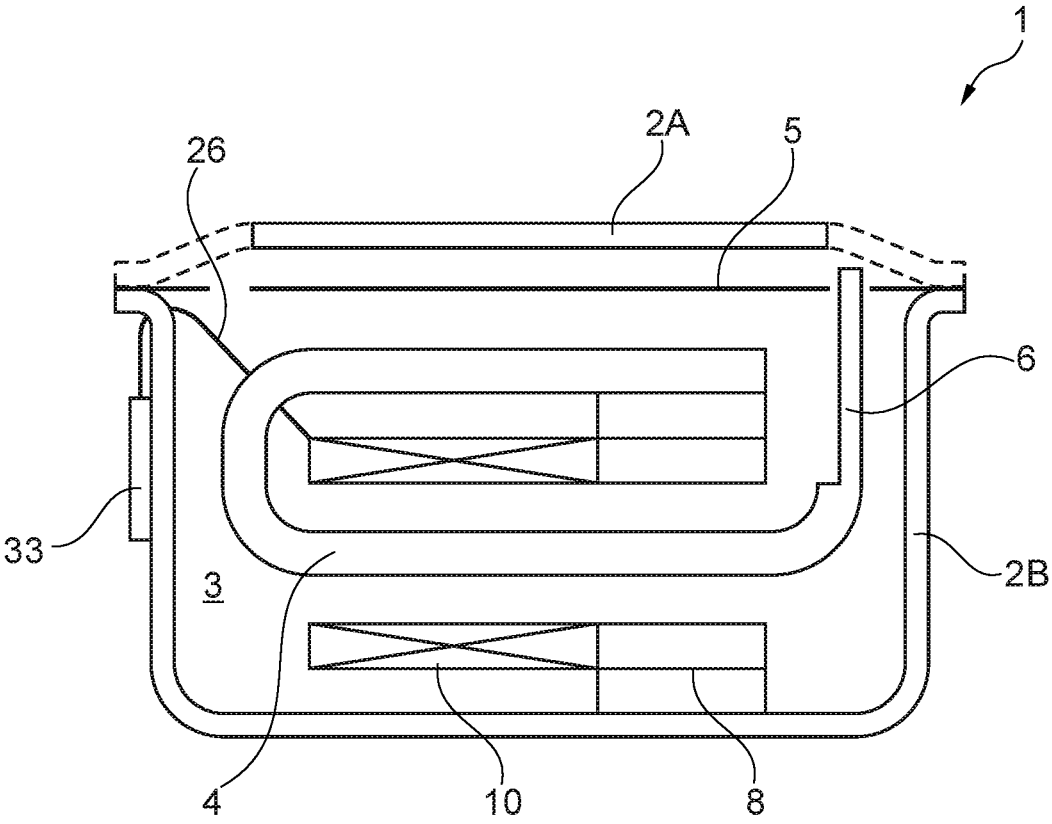
FIG. 25 illustrates an eight step of manufacturing a receiver assembly.

FIG. 25 illustrates an eight step of manufacturing a receiver assembly 1. During the eight step, the drive pin 6 is attached to the diaphragm 5 via the opening 24. Furthermore, the first and second housing parts 2A, 2B are attached to each other to form a closed inner space 3. The diaphragm 5 is sandwiched between the first housing part 2A and the second housing part 2B by arranging a circumferential edge part of the diaphragm 5 in the joint between the first housing part 2A and the second housing part 2B.

The invention claimed is:

1. A receiver assembly comprising:

a receiver housing comprising a first housing part and a second housing part, the receiver housing defining an inner space, wherein the first housing part and the second housing part are movable relative to each other to define an open configuration and a closed configuration, an armature extending in a first direction in the inner space, a diaphragm operationally attached to the armature via a drive pin extending in a second direction, the first and second directions being different, wherein the drive pin and the armature are formed in one part, wherein a circumferential edge part of the diaphragm is arranged in a joint between the first housing part and the second housing part in the closed configuration, and wherein the armature has a width being perpendicular to the first direction and along the first direction, the width of the armature being at least twice a width of the drive pin.

2. A receiver assembly according to claim 1, further comprising a magnet assembly configured to provide a magnetic field in a gap, wherein the armature extends in the first direction in the gap.

3. A receiver assembly according to claim 1, wherein the drive pin and the armature comprises a bent transition portion, the armature extending in the first direction from the transition portion and the drive pin extending in the second direction from the transition portion.

4. A receiver assembly according to claim 1, wherein the armature has a thickness being perpendicular to the first direction and transverse to first direction, the thickness of the armature being at least 20 percent larger than a thickness of the drive pin.

5. A receiver assembly according to claim 1, wherein the drive pin and the armature comprises a bent transition portion, the armature extending in the first direction from the transition portion and the drive pin extending in the second direction from the transition portion, and wherein the armature comprises a first tapered section, whereby the width of the armature decreases toward the transition portion.

6. A receiver assembly according to claim 1, wherein the drive pin and the armature comprises a bent transition portion, the armature extending in the first direction from the transition portion and the drive pin extending in the second direction from the transition portion, and wherein the armature comprises a second tapered section, whereby the thickness of the armature decreases toward the transition portion.

7. A receiver assembly according to claim 1, wherein the drive pin comprises a bent section.

8. A receiver assembly according to claim 1, further comprising a second drive pin.

9. A receiver assembly according to claim 1, wherein at least one of the first housing part and the second housing part comprises at least one depression formed at an edge portion to form an opening between the first housing part and the second housing part in the closed configuration.

10. A receiver assembly according to claim 1, further comprising an acoustical venting opening connecting the inner space to an exterior volume outside the receiver housing, wherein the acoustical venting opening forms an acoustical passage at least through the diaphragm.

11. A receiver assembly comprising:

a receiver housing comprising a first housing part and a second housing part, the receiver housing defining an inner space, wherein the first housing part and the second housing part are movable relative to each other to define an open configuration and a closed configuration, an armature extending in a first direction in the inner space, a diaphragm operationally attached to the armature via a drive pin extending in a second direction, the first and second directions being different, wherein a circumferential edge part of the diaphragm is arranged in a joint between the first housing part and the second housing part in the closed configuration, and wherein the armature has a width being perpendicular to the first direction and along the first direction, the width of the armature being at least twice a width of the drive pin.

12. A personal audio device comprising a receiver assembly according to claim 1.

13. A method of assembling a receiver assembly according to claim 1, the method comprising the steps of:

providing a receiver housing, the receiver housing comprising a first housing part and a second housing part, the receiver housing defining an inner space, wherein the first housing part and the second housing part are movable relative to each other to define an open configuration and a closed configuration, providing a magnet assembly configured to provide a magnetic field in an air gap, providing an integral unit forming an armature and a drive pin, the integral unit being formed in one piece, providing a diaphragm, arranging the integral unit so that at least a part of the armature extends in a first direction in the air gap, bending the integral unit to form a bent transition portion, so that the armature extends in the first direction from the transition portion and the drive pin extends in a second direction from the transition portion, the first and second directions being different, arranging a circumferential edge part of the diaphragm along an edge portion of one of the first housing part and the second housing part, and joining the first housing part and the second housing part so that the circumferential edge portion of the diaphragm is located in a joint between the first housing part and the second housing part, wherein the armature has a width being perpendicular to the first direction and along the first direction, the width of the armature being at least twice a width of the drive pin.

14. A personal audio device comprising a receiver assembly according to claim 11.

15. A receiver assembly according to claim 2, wherein the drive pin and the armature comprises a bent transition portion, the armature extending in the first direction from the transition portion and the drive pin extending in the second direction from the transition portion.

16. A receiver assembly according to claim 5, wherein the drive pin and the armature comprises a bent transition portion, the armature extending in the first direction from the transition portion and the drive pin extending in the second direction from the transition portion, and wherein the armature comprises a second tapered section, whereby the thickness of the armature decreases toward the transition portion.

* * * * *